United States Patent [19]

Greene

[11] Patent Number: 5,007,347

[45] Date of Patent: Apr. 16, 1991

[54] MODULAR MISSILE UPGRADE APPARATUS

[75] Inventor: Sidney R. Greene, Tucson, Ariz.

[73] Assignee: Hughes Aircraft Company, Los Angeles, Calif.

[21] Appl. No.: 382,154

[22] Filed: Jul. 19, 1989

[51] Int. Cl.[5] ..... F42B 10/00; F42B 12/02

[52] U.S. Cl. ..... 102/473; 102/293

[58] Field of Search ..... 102/473, 272, 374, 293

[56] References Cited

U.S. PATENT DOCUMENTS 3,677,179 7/1972 Potteiger et al. ..... 102/473
4,051,414 9/1977 Will et al. ..... 361/415
4,781,117 11/1988 Garnett et al. ..... 102/493
4,815,383 3/1989 Ward et al. ..... 102/293

*Primary Examiner*—Charles T. Jordan
*Assistant Examiner*—Rochelle Lieberman
*Attorney, Agent, or Firm*—R. M. Heald; C. D. Brown; W. K. Denson-Low

[57] ABSTRACT

A mechanism for upgrading a missile to be effective against reactive armor. The invention includes an adaptor (11) for mounting a probe module (10) with a warhead (13). The probe module has a charge in its extensible tip. A faring (12) over the five inch warhead reestablishes the aerodynamics of the missile.

6 Claims, 2 Drawing Sheets

MODULAR MISSILE UPGRADE APPARATUS

BACKGROUND OF THE INVENTION

1. Field of the Invention

This invention relates generally to modular missiles and more particularly to tube-launched optically-tracked wire-guided missiles.

2. Description of Related Art

These missiles were developed around two decades ago as portable missiles to be used against ground based vehicles or installations. These original missiles, and successors variations, were designed in a modular fashion. As an example, the electronics module is a separate unit and can be upgraded easily without requiring modification to the remainder of the missile. Similarly, all of the basic components of the missile are designed in modules to permit easy upgrades as technology advances.

These missiles typically utilize a shaped charge warhead. The shaped charge warhead contains a conical shaped copper liner which collapses and melts during detonation and explosion of the warhead. The melted copper forms a plasma jet that is directed out the front of the warhead towards the target.

One disadvantage of these missiles is that the switch which initiated detonation of the warhead was placed only a few inches from the copper liner and did not permit enough time for the plasma jet to be completely formed before the exploding warhead collided with the target. Hence, the maximum effectiveness of the plasma jet was not obtained.

One modular improvement made to these missile is the replacement of the rudimentary nose module with an updated warhead with a probe module having an extensible probe to provide standoff detonation. The probe extends upon launch ahead of the warhead and contains a switch which activates the warhead detonation. The extensible probe permits enough time for the plasma jet to be properly formed before collision between the warhead and the target. This feature increases the armor-piercing capability of the missile.

Subsequent missiles were developed with a heavier and more powerful warheads and also with an extensible probe for increased standoff detonation.

In response to these improvements in warhead efficiency, reactive armor was developed. When reactive armor explodes, a sheet of steel is forced upward through the plasma jet. Although the plasma jet easily burns the steel, the reactive armor is placed at an angle so that the rising sheet of steel presents an ever fresh steel face which breaks up the plasma jet, thereby destroying the plasma jet's effectiveness.

To counter the reactive armor development, a small charge was placed behind the tip switch in the extensible probe. Detonation of the warhead was delayed for a..short period of time after detonation of the tip charge in the extended probe. The small charge activated the reactive armor, thereby clearing the way for the warhead's plasma jet to defeat the unprotected armor on the side of the tank or other such target.

SUMMARY OF THE INVENTION

The present invention recognizes the limitations of existing the tube-launched missiles relative to reactive armor. For these missiles, the existing probe module without a tip charge is removed and discarded. An adaptor connects the existing warhead to a probe module containing an extensible probe with a tip charge. Suitable wiring is accomplished through the use of a single cable. A faring is added to create the proper aerodynamics for the enhanced tube-launched missile of the present invention.

Within the preferred environment of the present invention, modification of an modular tube-launched missile having a five inch warhead, the steps taken are:

(1) The existing five inch probe module of the missile is removed and discarded;

(2) The five-inch warhead module of the missile is removed from the missile;

(3) The Safe and Arm (S&A) of the warhead is disconnected from the electronics module; a new cable is connected to the wires from the electronics module and the wires to the S&A of the five inch warhead;

(4) The warhead is reattached to the missile; the new cable is placed along the outside of the warhead and threaded through an orifice in the adapter;

(5) The faring is secured to the six inch neck of the adaptor (creating the proper aerodynamics for the missile);

(6) An adaptor and faring are attached to the five inch warhead; the adaptor has another neck being six inches in diameter; and, (7) A six inch probe module with extensible probe with tip charge is wired to the new cable prior to the probe module being attached to the six inch neck of the adaptor.

DESCRIPTION OF THE PREFERRED EMBODIMENTS

Figure 1:
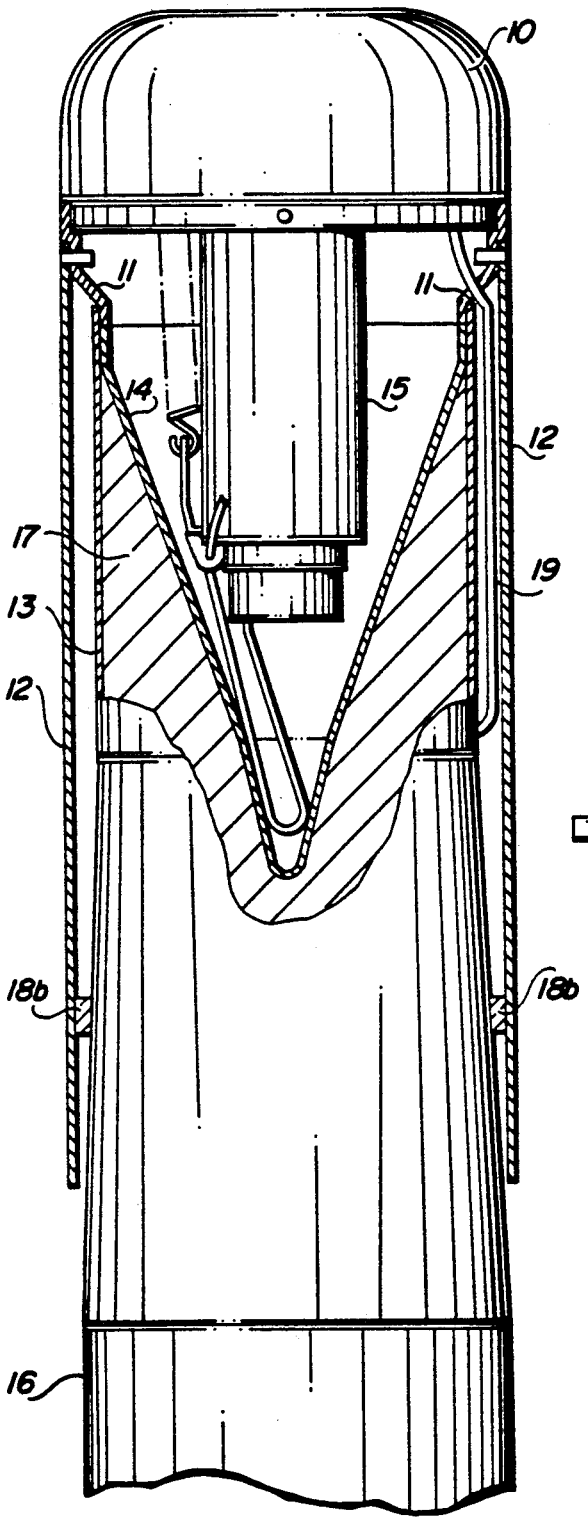
FIG. 1 is a cutaway view of an embodiment of the invention illustrating the interrelationship of the six inch probe module, the adaptor, and the five inch warhead.

FIG. 1 is a cutaway view of an embodiment of the invention, mating a six-inch probe module to a five-inch warhead module.

In this embodiment, the six inch probe module 10, shown in a stowed condition, is attached to the six inch neck portion of adaptor 11. The five inch neck portion of adaptor 11 attaches to the five inch warhead 13 of missile 16.

Warhead module 13 consists of an explosive charge 17 with a copper liner 14. The combination of explosive charge 17 and copper liner 14 creates a shaped charge which forms the plasma jet. During explosion of explosive 17, the copper liner 14 collapses, melts, and forms the plasma jet which is used to penetrate the armor of the target vehicle.

Faring 12 connects to the six inch neck of adaptor 11 and extends past the warhead module 13 to the portion of the tube-launched missile 16 which is six inches in diameter. In this manner, the aerodynamics of the missile is preserved even though it now has a six inch probe module.

Probe extension 15 is periscoped within the probe module 10 during shipment and is only extended at launch. Probe extension 15 easily stores within the cavity formed by copper liner 14. Since probe extension 15 is extended at launch, and therefore at the point of detonation, the cavity formed by the copper liner 14 is left undisturbed during use of the enhanced missile.

Scuff pads **18*b* are attached to adapter 11** and are used to center the missile at the forward end within its launch tube and guide the missile during its launch from the tube.

Pads **18*b* support and center the faring around the reduced area of missile 16**.

Wire cable 19 transfers power from the electronics unit (not shown) to the probe module 10.

Figure 2:
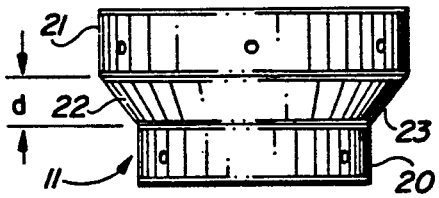
FIG. 2 is a side view of an embodiment of the adaptor.

FIG. 2 illustrates the adaptor used in the embodiment first described in FIG. 1. In this embodiment, adaptor 11 has three basic sections: the five inch neck 20; the six inch neck 21; and the expansion joint 22.

The length of the expansion joint 22, illustrated by d, is chosen to make the enhanced missile have the same general overall length as a regular tube-launched missile. This eliminates the need for any modification to the accessory equipment such as shipping boxes, launch tubes, etc.

Also located in the expansion joint 22 is orifice 23 which permits the wire cable (not shown) to pass between the electronics unit (not shown) of the missile and the probe module.

Although this embodiment illustrates that the six inch collar 21 is ahead of the five inch collar 20, those of ordinary skill in the art readily recognize that the distance, d, of the expansion joint 23 is adjustable to fit the requirements of the missile being modified. It is totally possible that the expansion joint for some missiles has the wider diameter neck actually placed behind the smaller diameter neck. The adaptor for this situation would be shaped like a "Z" and would be used to shorten the missile length.

The distance d of the expansion joint 23 also enhances the missile by increasing the standoff distance between the target and the warhead, thereby increasing the effectiveness of the plasma jet's penetration.

Figure 3:
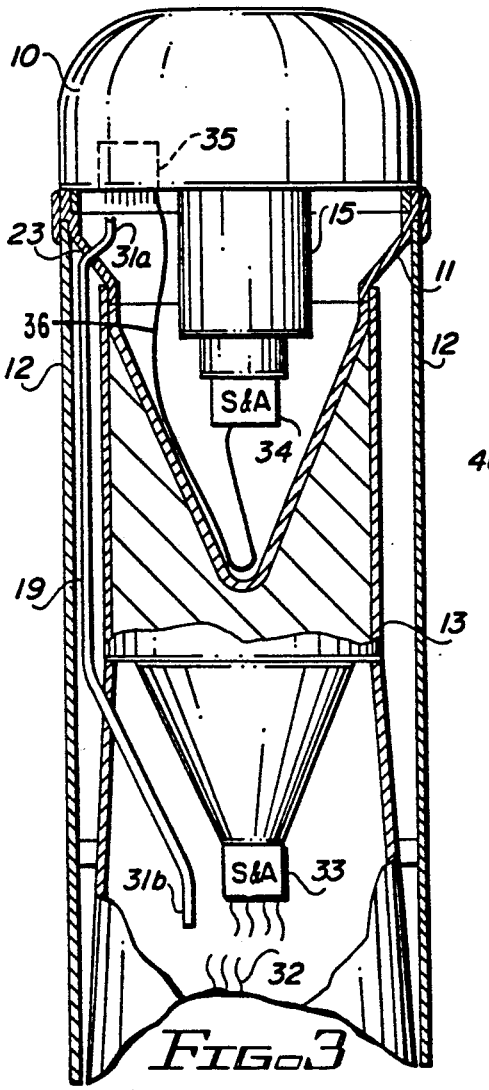
FIG. 3 is a cutaway view of an embodiment of the invention illustrating the wire cable and it's function.
Figure 4A:
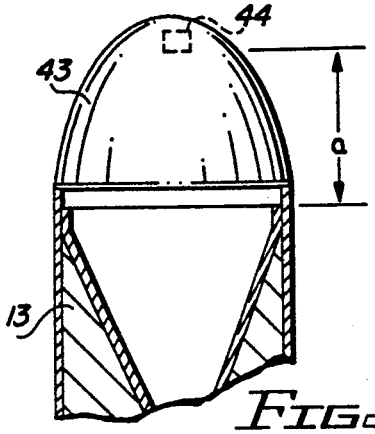
FIG. 4*a* is a cutaway side view of a typical tube-launched modular missile's nose without an extensible probe.
Figure 4B:
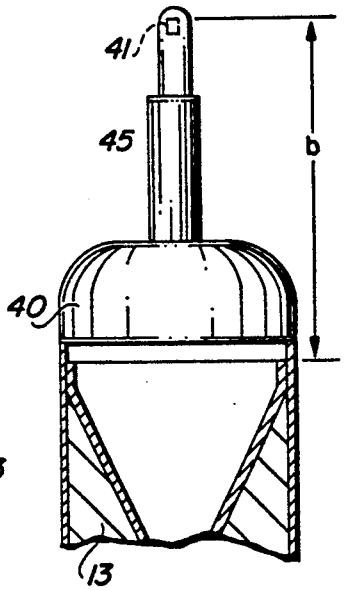
FIG. 4*b* is a cutaway side view of a tube-launched missile with the extensible probe extended but lacking a tip charge.
Figure 4C:
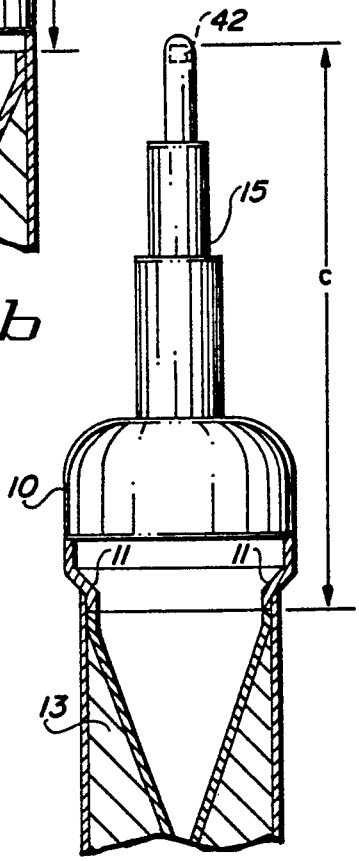
FIG. 4*c* is a cutaway side view of a missile utilizing the present invention to incorporate a probe module with extensible probe with tip charge on an existing tube-launched missile.

FIG. 3 illustrates the wiring concerns when the missile is modified to become the enhanced missile of this invention. The five inch warhead 13 has a three wire connection. In the traditional missile arrangement, these three wires attach to three wires from the Electronics Unit (EU) module 32. The three wires are used for the Safe and Arm (S&A) 33 operation.

For the modification of the typical tube-launched missile, these three wires are disconnected and reconnected to three wires at end **31*b* of wire cable 19. Four additional wires from the cable 19 at end 31*b* of wire cable 19. end 31*b*, are connected to the S&A 33**.

Wire cable 19 extends between faring 12 and the exterior of warhead 13 entering through the orifice 23 in adaptor 11.

Wire cable 19 supplies power from the electronics unit 32 to the controller 35. This power is supplied by connection of end **31*a* to the controller 35. Controller 35 activates the S&A 33 of the warhead module 13 via wire cable 19. Additionally, controller 35 activates the Safe and Arm (S&A) 34 of the tip charge via wire cable 36**.

Operationally, a switch (see FIG. **4*b*) located at the end of probe extension 15 is closed through the crushing of the probe from impact with the target. This causes the controller 35 to detonate the tip charge (not shown) in probe extension 15 via wire cable 36. A selected delay is created before warhead 13 is detonated by controller 35**.

In this manner, of detonating the extended probe tip charge and waiting a selected amount of time before detonating the warhead, the enhanced missile not only nullifies the effectiveness of reactive armor, but it also assures that the plasma jet is fully formed before the missile's warhead collides with the target.

FIG. **4*a* illustrates the relationship of a traditional tube-launched nose module 43 without an extensible tip, warhead 13, and activation switch 44. The distance between the leading edge of warhead 13 and the activation switch 44, contained within nose 43**, is indicated by "a". This distance does not establish enough of a standoff to permit the plasma jet to be fully formed.

FIG. **4*b*** illustrates the typical tube-launched missile probe module with extensible probe but without a tip charge.

In FIG. **4*b*, the missile has an extensible probe 45 with a contact sensing switch 41** at the tip thereof. This increases the standoff distance to "b" and permits an optimal plasma jet to be formed. However, the plasma jet alone is ineffective against vehicles with reactive armor.

In the enhanced missile of the present invention, illustrated in FIG. **4*c*, probe 15 is extended at launch. This extension of probe 15 places the contact sensing switch 42 a distance, "c", from the leading edge of warhead 13. This distance, c, provides more than enough time for warhead 13** to properly create the desired plasma jet.

Additionally, probe 15 contains a tip charge (not shown) in the vicinity of contact sensing switch 42 which is detonated upon contact of probe 15 with the target. This detonation activates any reactive armor on the target so that it is removed from the missile's path permitting the plasma jet of the missile to address the now unprotected armor of the target.

Figure 5:
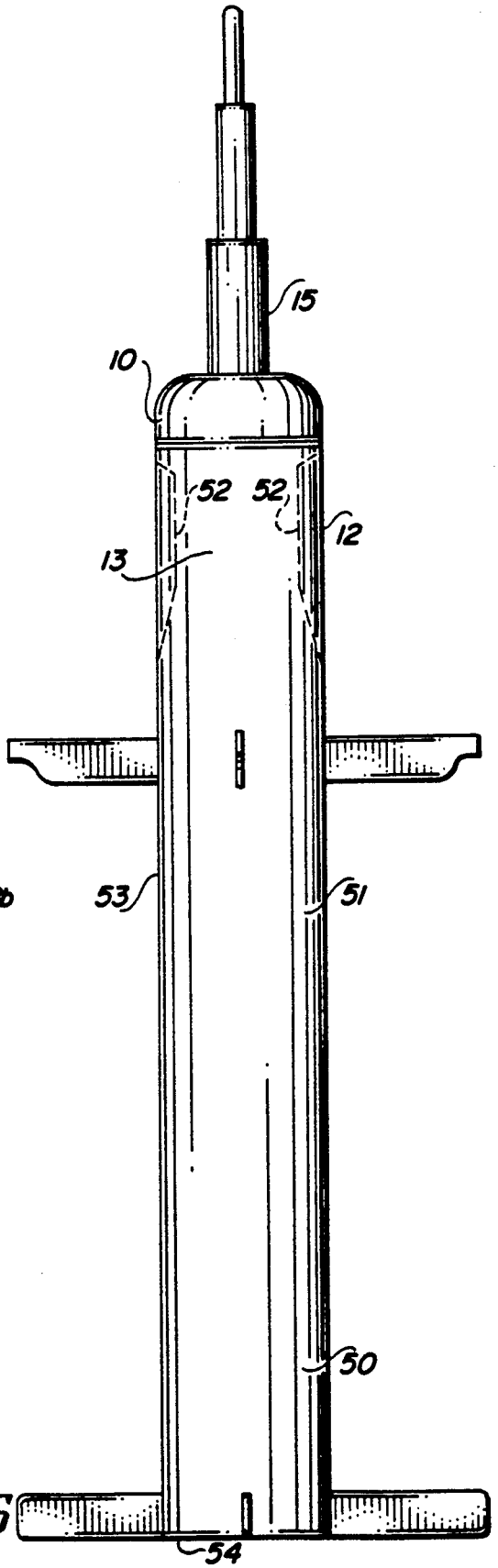
FIG. 5 is a side view a modified tube-launched missile in flight configuration.

FIG. 5 illustrates the enhanced missile of the present invention in flight configuration. After launch, probe extension 15 is extended past the front of probe module 10. Warhead 13, the outline of which is noted by 52, is a standard five inch warhead and is contained within faring 12.

The enhanced missile's activity is controlled by electronics unit 51 and is well known in the art. Propulsion module 50 provides propulsion and the launch motor 54 provides launching of the enhanced missile of this invention. Propulsion module 50 and the launch motor 54 are well known in the art.

It is clear from the forgoing that the present invention provides for an enchanced tube-launched modular missile requiring minimal modification.

What is claimed is:

1. A kit for the conversion of a missile to provide an improved warhead module (13), said kit comprising:

(a) an adapter (11) having a first neck and a second neck, said first neck being attachable to said warhead module;

(b) a probe module (10) attachable to the second neck of said adapter; and, (c) a faring (12) attachable to the second neck, said faring extending past said warhead module.

2. The kit according to claim 1 wherein probe module includes:

(a) an extensible probe (15) having an explosive charge therein; and, (b) a control device (35) for activation of said explosive charge within said extensible probe and said warhead module.

3. The kit according to claim 2 further comprising a cable system (19), said cable system for providing power from an electronic unit to said control device.

4. The kit according to claim 2 wherein said control device includes means for delaying activation of the explosive charge within said warhead module for a predetermined amount of time after activation of the explosive charge within said extensible probe.

5. A method of converting a missile having an electronics module (51), a warhead module (13), and a probe module (40), to be effective against reactive armor, said method comprising the following steps of:

(a) removing the probe module of the missile from the warhead;

(b) disconnecting wires extending between the probe module and the electronics module of the missile;

(c) placing a faring (12) over the warhead;

(d) connecting a first side of an adaptor (11) to said warhead;

(e) connecting said faring to a second side of said adaptor; and, (f) connecting a probe module (10) to a second side of said adaptor.

6. The method according to claim 5 further comprising the steps of:

(a) after the disconnection of the wires from the electronics module, connecting a wire cable (19) to said wires, extending from the electronics module and to a safe and arming device (33);

(b) after connecting the first side of an adaptor to said warhead, inserting said wire cable through an orifice (23) in said adaptor; and, (c) before connecting the probe module to the second side of said adapter, connecting the wire cable to said probe module, thereby permitting the probe module to communicate with the electronics module.

* * * * *